United States Patent [19]

Kreiseder et al.

[11] Patent Number: 4,598,837

[45] Date of Patent: Jul. 8, 1986

[54] END CLOSURE WITH TAMPER EVIDENT ELEMENT

[75] Inventors: Walter J. Kreiseder, Barrington; Allen J. Vogel, Schaumburg, both of Ill.

[73] Assignee: Courtesy Mold & Tool Corporation, Wheeling, Ill.

[21] Appl. No.: 783,732

[22] Filed: Oct. 3, 1985

Related U.S. Application Data

[63] Continuation-in-part of Ser. No. 683,068, Dec. 18, 1984, Pat. No. 4,567,995.

[51] Int. Cl.[4] ..... B65D 51/18

[52] U.S. Cl. ..... 220/253; 220/214; 220/258

[58] Field of Search ..... 220/253, 214, 266, 257, 220/258, 260, 267; 222/153, 480, 516, 548, 541

[56] References Cited

U.S. PATENT DOCUMENTS

| | | | |
|---|---|---|---|
| 3,912,128 | 10/1975 | Ziemann et al. | 222/541 |
| 4,274,563 | 6/1981 | Otterson | 222/480 |
| 4,541,541 | 9/1985 | Hickman et al. | 220/253 |

*Primary Examiner*—George T. Hall

*Attorney, Agent, or Firm*—Allegretti, Newitt, Witcoff & McAndrews, Ltd.

[57] ABSTRACT

An end closure for a container comprising an end cap and a cover rotatable with respect to the end cap. The end cap has a raised portion connected to the main part of the end cap by a thinned, severable wall. The raised portion fits within an opening in the cover, which opening is defined at least in part by a knife edge. Upon rotation of the cover relative to the end cap, the knife edge will cut through the severable wall and sever the raised portion from the end cap. A pour opening is defined in the end cap when the raised portion is severed. When the opening in the cover is aligned with the pour opening in the end cap, the contents of the container may be dispensed. When the opening in the cover is out of registry with the pour opening in the end cap, no contents may be discharged. Complementary interengaging flanges on the end cap and cover retain the parts in assembled relationship.

A tamper evident element is detachably secured within the opening in the cover by frangible sections. The frangible sections are readily broken upon movement of the cover relative to the end cap in a direction to cut the raised portion; thereby evidencing to the user that the container has been tampered with and that the sealed condition may have been breached.

6 Claims, 18 Drawing Figures

TO BE SEVERED HERE

Fig.6
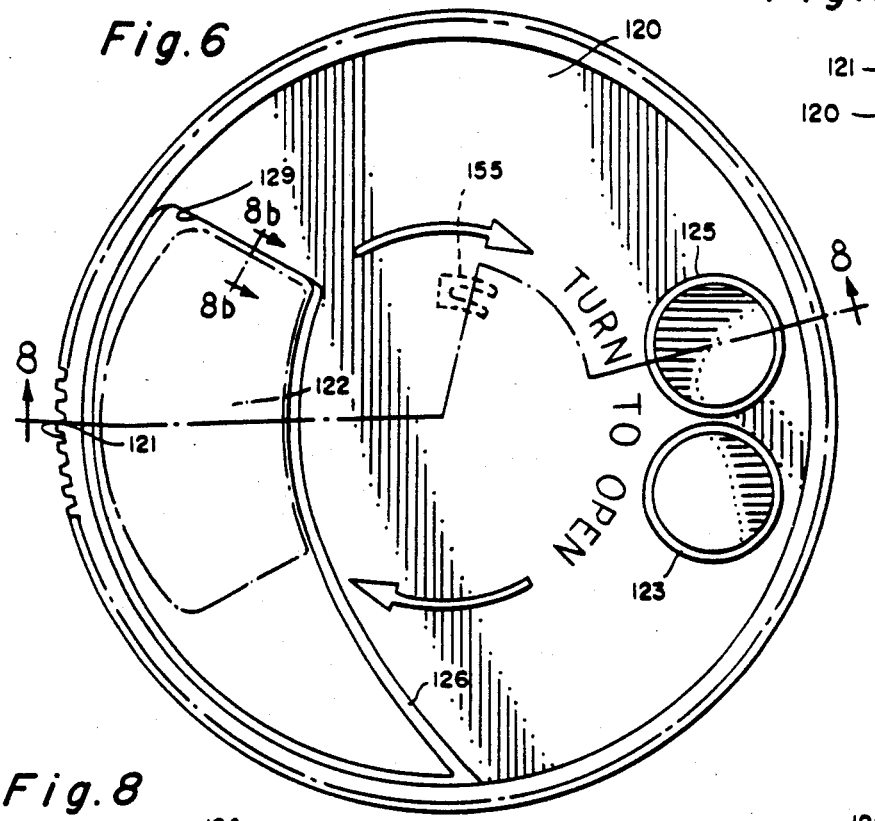
Fig.7
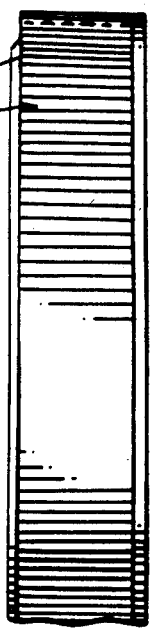
Fig.8
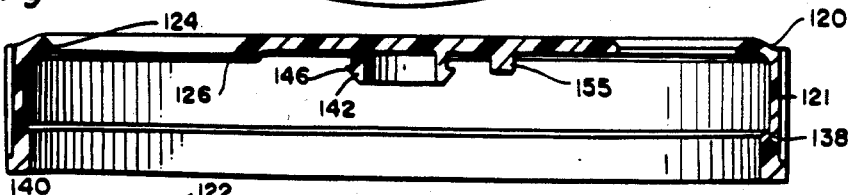
Fig.8a
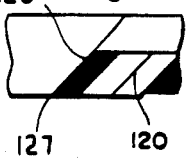
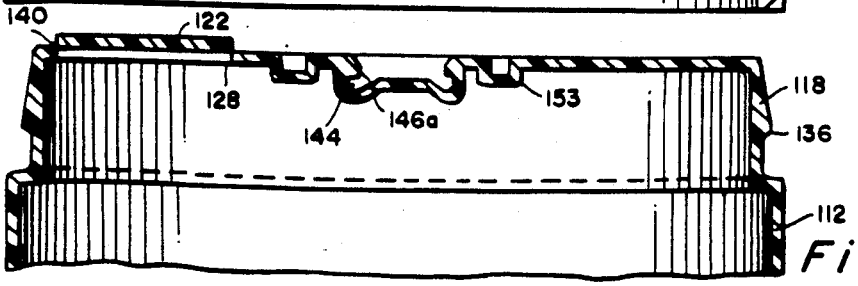
Fig.8b
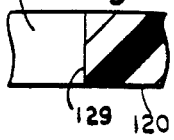
Fig.9
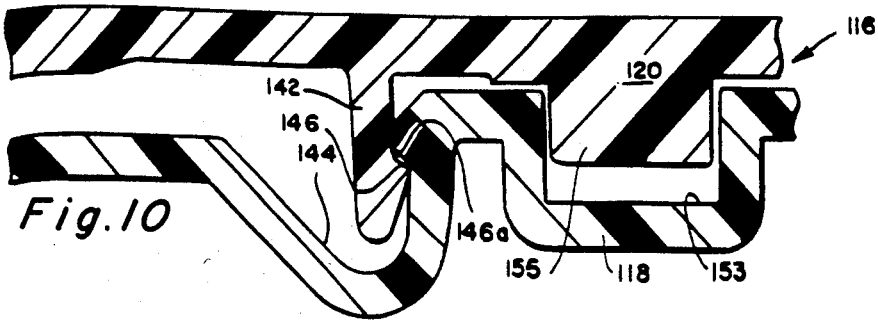
Fig.10

END CLOSURE WITH TAMPER EVIDENT ELEMENT

RELATED APPLICATION

This application is a continuation in part of application Ser. No. 683,068 field Dec. 18, 1984 and entitled END CLOSURE now U.S. Pat. No. 4,567,995.

BACKGROUND OF THE INVENTION

The present invention pertains to an end closure for a container and more particularly, to an end closure for a container containing grated cheese, bread crumbs or like food product for maintaining the container in a sealed condition after packaging and for opening a pour opening in the end closure upon first actuation of a first end closure part with respect to a second end closure part to permit the contents to be dispensed as needed. The end closure incorporates a temper evident element to indicate to the user whether or not the sealed condition has been breached.

Containers for food products, such as bread crumbs, grated cheese, and spices, usually include an end closure for closing the container. The end closure may include an end cap of metal or plastic affixed to the container body which may be made of paper. The bottom may be closed by a metal or plastic member secured to the container body. Usually, the end cap has one or more pour openings therein. A cover is rotatably mounted on the end cap through an opening in the end cap for selectively opening and closing a pour opening. The pour opening is often defined by a tab formed flush in the end cap and connected to the end cap by wall portions of reduced thickness. Often the end cap has perforations therein for outlining the pour opening, in addition to the opening for journalling the cover. Therefore, the container is not hermetically closed, and there is often degradation or deterioration of the food product from the time it is packed until it is sold. Shelf life is shortened or there may actually be spoilage. The end closures described above are shown generally in U.S. Pat. Nos. 3,912,128 and 4,274,563.

To open the end cap, a tool or finger is inserted against the tab to break the wall portions and the tab is pushed into the container. If a finger is used, a nail of the user may be broken. In some cases, where the end cap has been made from polystyrene, particles of plastic have broken off and mixed with the contents, thereby contaminating the food with undesirable and perhaps harmful non-food matter. The tab in the container may interfere with pouring of the contents from the container. Hence, it has been suggested to provide means to prevent the tab removed from the end cap from falling into the container. As shown in Ziemann et al. U.S. Pat. No. 3,912,128, such means may comprise fulcrum pins securing the tab to the end cover after the reduced thickness wall has been severed. In a similar manner, Otterson U.S. Pat. No. 4,274,563 provides hinge pins to secure the tab to the end cover so that it can remain hinged and not drop into the contents of the container.

Our prior application Ser. No. 683,068 improved upon such prior end closures by providing a novel end closure wherein a raised portion or tab defining the pour opening will be automatically cut and urged outwardly from the end closure upon rotation or movement of a first end closure part relative to a second end closure part. The present invention provides a tell tale or tamper evident element which will be ruptured upon initial movement of the first end closure part with respect to second end closure part in a direction to cut the raised portion.

An object of the present invention is to provide an end closure with a temper evident element wherein disadvantages and deficiencies of prior constructions are obviated.

Another object of the present invention is to provide an improved end closure having a cover and an end cap movable with respect to one another for automatically severing a tab from the end cap to form a pour opening, said tab being urged outwardly and severed from the end cap without dropping into the contents of the container, and a tamper evident element which will be broken upon initial movement of the cover with respect to the end cap in a direction to cut the tab.

Other objects and advantages of the present invention will be made more apparent hereinafter.

BRIEF DESCRIPTION OF THE DRAWING

There is shown in the attached drawing a presently preferred embodiment of the present invention, wherein like numerals refer to like elements in the various views and wherein:

FIG. 6 is a plan view of the rotatable cover of a modified end closure, with the pour opening in the end cap being shown in phanton and illustrating a modified knife means;

FIG. 7 is a side view of the rotatable cover of FIG. 6;

FIG. 8 is a cross-sectional view of the rotatable cover taken generally along the line 8—8 of FIG. 6;

FIG. 8*a* is an enlarged detail view of the knife edge on the rotatable cover;

FIG. 8*b* is an enlarged detail view of the rotatable cover taken generally along line 8*b*—8*b* of FIG. 6;

FIG. 9 is a cross-sectional view of a modified container, illustrating an end cap that is formed integrally with the container;

FIG. 10 is an enlarged detail view showing the central connection of the end cap and rotable cover of FIG. 8;

DETAILED DESCRIPTION OF THE PRESENT INVENTION

Figures 1, 2, 3, 4, 5, 11, 12:
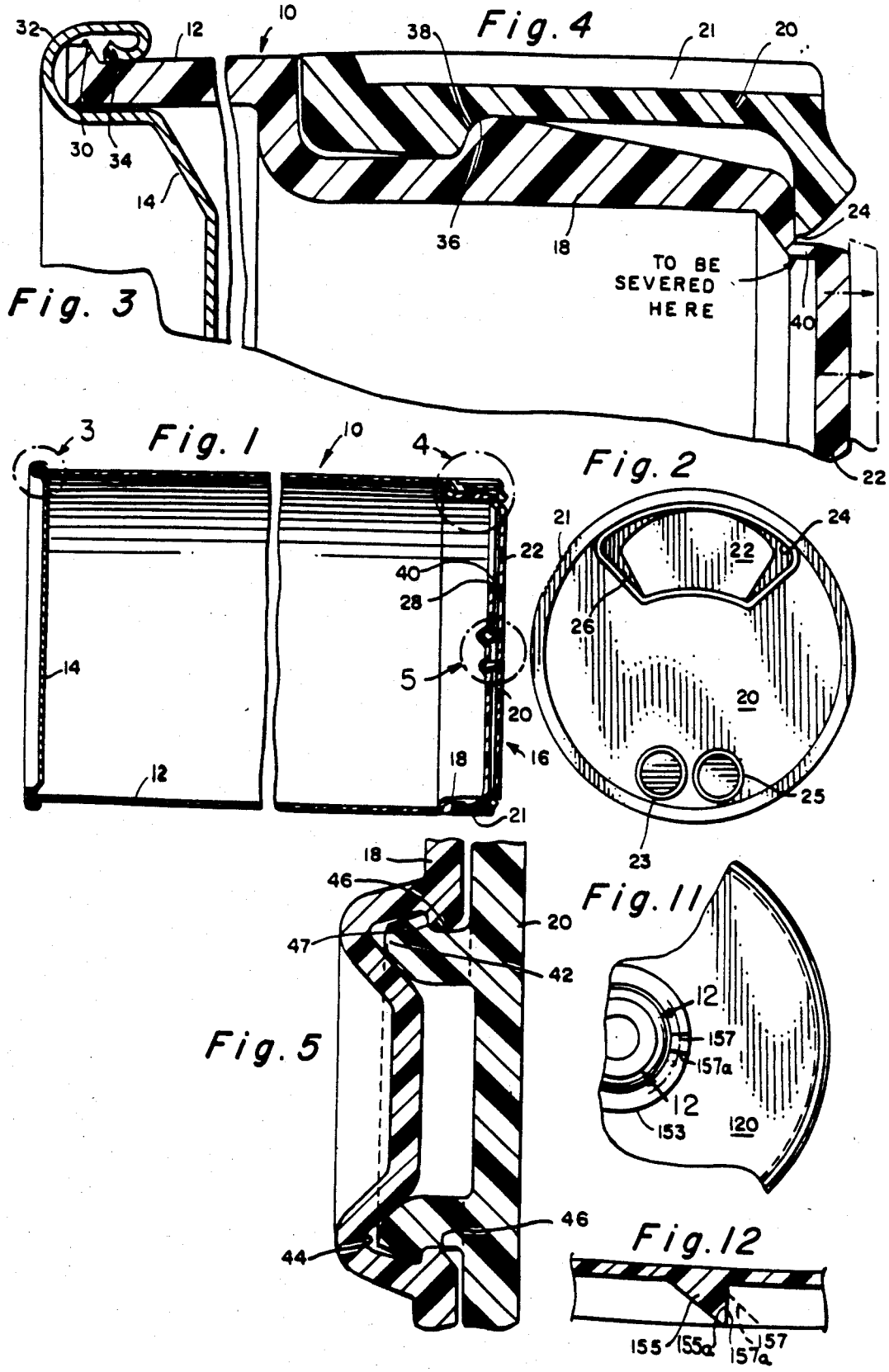
FIG. 1 is a cross-sectional view of a container incorporating an end closure of this invention.
FIG. 2 is a plan view of the container of FIG. 1, illustrating one form of knife means on the cover for severing the raised portion from the end cap of the end closure.
FIG. 3 is an enlarged detail cross-sectional view of the container taken within the the circle 3 of FIG. 1, illustrating the connection of the bottom to the side wall of the container.
FIG. 4 is an enlarged detail cross-sectional view of the container taken within the circle 4 of FIG. 1, illustrating the connection of the side of the end cap of the end closure to the side wall of the container.
FIG. 5 is an enlarged detailed cross-sectional view of the container taken within the circle 5 of FIG. 1, illustrating the central connection of the stationary end cap with the rotatable cover.
FIG. 11 is a plan view of the end cap of the end closure illustrating a groove and tooth which form part of the means for preventing retrograde motion of the rotatable cover relative to the end cap once cutting of the raised portion has begun.
FIG. 12 is a detail view of the means for preventing retrograde motion between the end cap and rotable cover taken generally along line 12—12 of FIG. 11.
Figure 14:
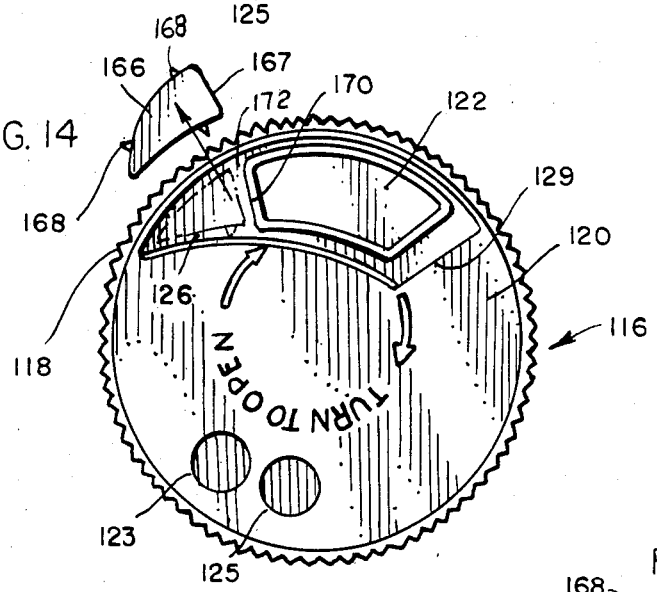
FIG. 14 is a plan view of a container illustrating removal of the tamper evident member upon initial rotation of the rotatable cover with respect to the end cap.
Figure 16:
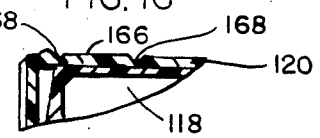
FIG. 16 is a detail cross-sectional view of the container taken generally along line 16—16 of FIG. 13.
Figure 15:
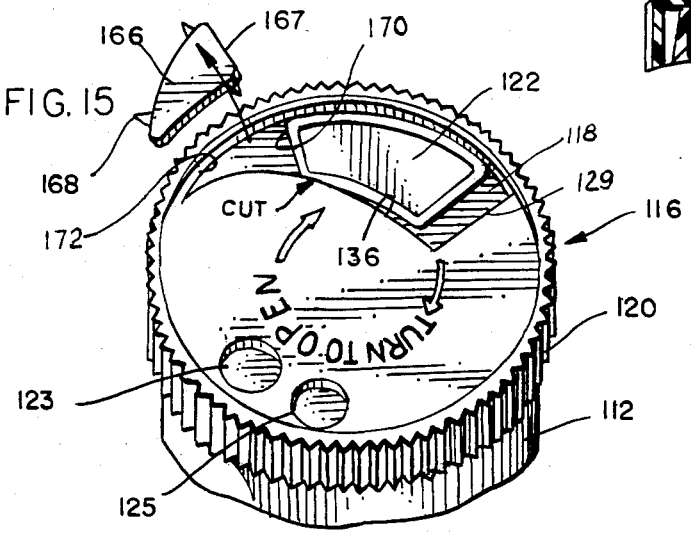
FIG. 15 is a perspective view of a container similar to FIG. 14 illustrating removal of the tamper evident element upon initial rotation of the rotatable cover with respect to the end cap.

There is shown in FIGS. 1–5 a container 10 having a generally cylindrical body 12 with a side wall closed at one end by bottom 14 and closed at the other end by end closure 16. The end closure 16 includes an end cap 18 formed integrally with the side walls 12 of the container as shown in FIG. 1 or alternatively, the end cap 18 may be formed separate from the container side walls 12 (as shown in FIGS. 14, 15 and 16) and then separately affixed thereto. The end closure 16 also includes a cover 20 that is movable with respect to the end cap 18 as will be explained in more detailed hereinafter.

The end cap 18 is formed with a raised portion 22 that is secured to the end cap by a thinned severable wall section 40. The wall section 40 extends entirely about raised portion 22. The raised portion 22 of end cap 18 fits within an opening 24 in the cover 20. Also provided in the cover 20 are separate smaller openings 23 and 25, as will be explained more fully hereafter. The container 10 with end closure in place may be filled with product such as bread crumbs, grated cheese and the like and then the bottom 14 applied to seal the container. The container 10 and the end closure 16 may be made from plastic. The bottom 14 may be plastic or aluminum. Since there is no opening in the end cap, the container 10 is hermetically sealed. The contents are protected from contamination and shelf life is prolonged.

The user will rotate the cover 20 relative to the end cap 18 in order to force the knife means 26 which define the opening 24 in the cover to cut through and sever the thinned wall section 40 of the raised portion 22 and thereby raise the raised portion 22 and urge same outwardly from the cover 20. Preferably, the rotatable cover is made from a harder plastic than the end cap 18 so as to more readily sever the wall section 40. With the raised portion 22 severed and discarded, there is defined within the end cap 18 a pour opening 28 through which the product from within the container 10 may be dispensed. With the opening 24 in the cover 20 aligned with the opening 28 in the end cap, a large pour opening is provided. The cover 20 may be rotated to an intermediate position covering the opening 28, in which case the container 10 is resealed. The cover 20 may be rotated relative to the end cap 18 to position one or both of the openings 23, 25 over the pour opening 28 to pour a lesser quantity of material from the container 10 than when opening 28 is aligned with opening 24. The end cap 18 may be molded from a plastic, such as polypropylene which can be cut without breaking or shattering as might a brittle plastic such as polystyrene. Therefore, no particles of plastic will be introduced into the contents as a result of cutting away of the raised portion 22 to open the pour opening 28 in the end cap 18.

As shown in FIG. 3, the side wall 12 of the container 10 may be formed with an outwardly extending peripheral flange 30 at the bottom thereof. The bottom 14 includes a U-shaped section 32 including a rolled end 34 which is adapted to be engaged over the flange 30. The parts defining the U of section 32 are spaced apart a distance less than the thickness of side wall 12 in the region of flange 30. In assembly, the flange 30 is force fit into the U-shaped section 32. The flange 30 will cooperate with the U-shaped flange 32 to prevent removal of the bottom 14 from the container 10. If desired, an adhesive may be applied between bottom 14 and the side wall 12 of container 10 to bond the members more firmly to one another.

In the embodiment of FIGS. 1 and 4, the end cap 18 is formed integrally with the side walls 12, for example, by molding. Cooperating means are provided on the cover and the end cap for rotatably interconnecting the parts. An outwardly extending annular projection or flange 36 on the exterior of the side of end cap 18 cooperates with an annular flange 38 on the interior of the side of the cover 20 to help secure the cover 20 relative to the end cap 18, while still permitting motion of the cover 20 relative to the end cap 18. Flanges 36 and 38 provide cooperating members for connecting the sides of the cover 20 and the end cap 18. The flanges 36 and 38 have cooperating tapered faces to urge the cover 20 into tight engagement with end cap 18. The raised portion 22 of the end cap 18 is secured to the end cap by a thinned wall 40. In use it will be understood that the thinned wall 40 will be cut by the knife means 26 on the cover 20 upon rotation of the cover 20 relative to the end cap 18. The thinned wall 40 is provided entirely about the exterior of the raised portion 22 and when the raised portion or tab 22 is severed, the pour opening 28 is formed in end cap 18.

With reference to FIG. 5, there is better shown the cooperating members for rotatably connecting the center of the cover 20 to the center of the end cap 18. The end cap 18 is closed and has no opening therein prior to severing of the thinned wall 40 and removal of raised portion 22 to define the pour opening. Annular projection 42 on the cover 20 depends into container 12. The projection 42 has a generally circular outwardly facing flange 47 thereon. The flange 47 is spaced inwardly from the cover 20. The end cap 18 includes a recess 44 having an annular flange 46 that is generally complementary to the flange 47 on the cover 20. The internal diameter of the flange 46 is less than the external diameter of the flange 47. Since the parts are preferably manufactured of a tough resilient plastic, such as polypropylene, there will be a snap fit inter-engagement between the complementary engaging faces of flange 46 on end cap 18 and flange 47 on cover 20. Further, the cover 20 may be fabricated from a homopolymer material and the end cap 18 from a copolymer material. Since the homopolymer is harder than the copolymer, the knife means 26 on the cover 20 can more readily cut the wall section 40.

Upon assembly, the cover 20 will be positively retained relative to the end cap 18, assisted by the inter-engagement of the complementary flanges 36 and 38 on the sides of the end cap 18 and the cover 20. Both the cover 20 and end cap 18 are circular and rotary motion of the cover 20 relative to the end cap 18 is facilitated. The exterior of the side walls of the cover 20 may be ridged (or knurled) as best shown at 21 in FIGS. 2 and 4 to permit non-slip engagement of the user's hand with the cover 20.

In FIG. 6, there is shown a plan view of a modified cover 120 having a modified knife means 126. The raised portion 122 on the end cap is shown in phantom. The knife means 126 is formed integrally with the cover 120, as was the knife means 26 shown in FIG. 2, except that the knife edge 127 is extended along one side of the opening 124 in the cover in the form of a concave curve. The overall opening 124 looks somewhat like a partial moon. The wall portion 129 (FIGS. 6 and 8*b*) of opening 124 is flat and spaced close to the raised portion 122 to preclude counterwise rotation of the cover 120 relative to the end cap 118 when the raised portion 122 is in place. The knife means 126 (as with the knife means 26) tapers inwardly toward the bottom of the opening in the cover, to define the relatively sharp cutting edge 127, as best shown in FIGS. 8 and 8*a*. In use, the knife means 126 (FIG. 6) functions in a similar, but improved fashion to the knife means of FIG. 1. Knife means 126 will engage with and sever the thinned wall 140 which holds the raised portion 22 to the end cap 18 in a gradual fashion when rotated clockwise as shown in FIG. 6. The knife edge 126 engages a corner of the raised portion wall section 40 and upon continued rotations, engages more of the wall section. When the end of knife means 126 passes through wall section 140, the raised portion 122 will be completely severed from end cap 118. It has been found that the configuration of the knife means 126 illustrated in FIG. 6 lessens the force necessary to sever the raised portion as compared with the knife means 26 since there is a more gradual application of cutting or severing to the wall 140. The cover 120 includes a ridged edge 121, which is the same as the shown at 21 in FIG. 2.

FIGS. 8 and 9 illustrate cross sections of the two parts of the end closure 116. The cover 120 is shown in cross section in FIG. 8 and the end cap 118 is shown in cross section in FIG. 9. The parts illustrated in FIGS. 8 and 9 are juxtaposed to show the position just prior to assembly of the cover 120 to the end cap 118. The cover 120 will be pushed downwardly on the end cap 118, until the projection 142 engages within the recess 144, with the flange 146 on the end cap 118 engaging the complementary flange 146*a* on the cover 120. At the same time, the sides of the cover 120 move downwardly upon the sides of the end cap 118 until the inwardly extending flange 138 of the cover 120 engages beneath the outwardly projecting flange 136 on the end cap 118. The two components 118 and 120 of the end closure 16 are retained in assembled relationship after assembly, while permitting desired rotation between the cover 120 and the end cap 118, which, as shown, in FIG. 1, may be an integral part of the container 12.

FIG. 10 illustrates an enlarged detail view of the connection of the rotatable cover to the end cap 118 and particularly, the configuration of the recess 144 with its flange 146 adapted to engage the flange 146*a* on the projection 142 depending from the top of the cover 120.

Means are provided to prevent retrograde motion of the rotatable cover with respect to the end cap once severing of the wall section connecting the raised portion to the end cap has begun. Unauthorized tampering with the seal provided by the raised portion may be detected by the store owner or user. The retrograde preventing means comprise interengaging teeth on the end cap and cover respectively. In FIG. 6, there is shown in dotted line a tooth 155 which depends from the bottom of the rotatable cover 120. The center of the tooth 155 is slightly cored so as to prevent a sink or depression on the top of the cover 120 during molding. The end cap 118 is provided with a recess 153 generally complementary to the depth and sides of the tooth 155 for receiving said tooth therein. As shown in FIG. 11, the recess 153 is annular. The tooth 157 is inclined upwardly from the bottom of recess 153 and has a flat face 157*a* which is adapted to engage with the oppositely facing tooth 155 depending from cover 120. Tooth 155 includes a flat face 155*a* which is adapted to cooperate with flat face 157*a* prevent retrograde motion of the cover 120 relative to the end cap 118 once severing of wall section 140 begins. The teeth 155, 157 are arranged upon the cover and end cap respectively for positioning as shown in FIG. 12 just as the knife means 126 engages wall section 140. The inclined surface of tooth 155 may ride up the inclined surface on tooth 157. Just as the knife edge 126 engages the wall section 140, tooth 155 will ride over the edge of tooth 155 and be pulled downwardly toward the end cap by the inherent resiliency of the plastic forming the cover 120. The faces 155*a* and 157*a* will abut. Reverse rotation of the cover 120 relative to the end cap 18 is precluded. Continued rotations of the knife edge 126 to sever the wall 140 will be unimpeded.

Figure 13:
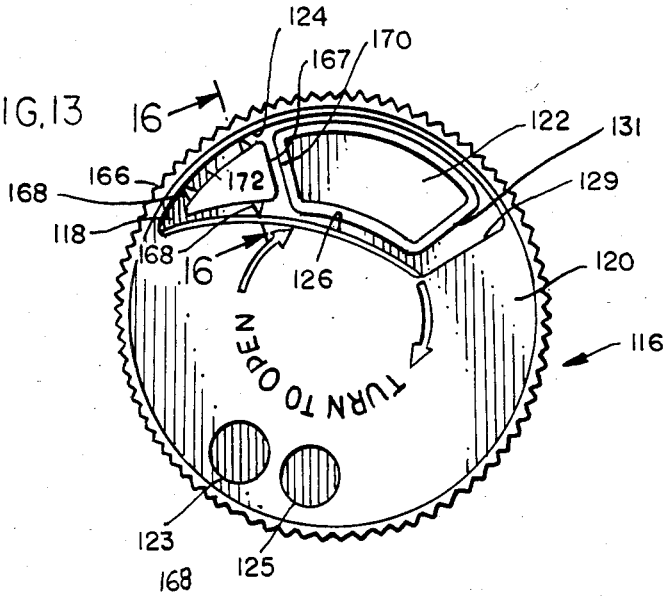
FIG. 13 is a plan view of a container showing a tell tale or tamper evident element in place in the opening in the rotatable cover.

It will be understood that in use, the knife means 126 engages the thinned wall 140 in a small area of the wall and upon continued rotation of cover 120 relative to the end cap 118, there will be continued cutting of the wall 140. The cut raised portion 122 moves upwardly onto the cover 120 and when cutting of the thinned wall 140 is completed, the raised portion 122 is entirely removed from the container. This has the advantage that there will be no foreign object entering the container, which object could subsequently impede pouring of the contents. The possibility of the user breaking a fingernail in trying to gain access to the container by pressing through or pressing downwardly on the tab portion of the end cap is eliminated. The seal provided by the manufacturer for the contents of the container is maintained until such time as the user desires to gain entry to the interior of the container by initial rotation of cover 120 relative to end cap 118, which severs and removes the raised portion 122 from the end cap 118 to provide a pour opening 128 in the end cap 118. The opening 124 in the cover 120 can be moved out of registry with opening 128 and holes 123, 125 to seal the contents and prevent inadvertent discharge if the container falls or is turned upside down. Reference may be made to FIG. 13 of my co-pending application Ser. No. 683,068 for a pictoral of the cutting action described.

In FIG. 13 there is plan view of an end closure 116 incorporating the tamper evident member 166 of the present invention. The tamper evident member or element 166 is disposed in opening 124 in cover 120 and is retained in place by frangible sections 168. Three frangible sections 168 are shown, but it is understood a different member may be employed. The frangible sections 168 may be triangular in plan, of reduced thickness as compared to the thickness of cover 120, and connected to the cover 120 only at the apexes of the triangular sections. At assembly, the cover 120 is secured to end cap 118 such that a wall 170 of the raised portion 122 is closely spaced from wall 167 of the tamper evident element 166. Wall 129 on cover 120 is relatively closely spaced from wall 132 of the raised portion 122. If the cover 122 is inadvertently rotated in a direction opposite from the arrow in FIG. 13, wall 129 on the cover 120 will abut wall 131 of the raised portion 122. Rotation of the cover 122 will be stopped. No cutting occurs, since the facing walls 129, 131 are substantially parallel to one another, and there is no cutting edge on either wall. Upon initial movement of the cover 120 relative to the end cap 118 in the direction shown by the arrow in FIGS. 13, 14 and 15, the wall 170 will engage the tamper evident element 166 before or just as the cutting edge or knife edge 126 engages the wall 170 of raised portion 122. A force is exerted against the tamper evident member 166, whereby the frangible sections 168 will be ruptured and the tamper evident member 166 will be dislodged or released and popped out from the end closure. With the tell tale or tamper evident element 166 dislodged or removed, it will be apparent that the cover 120 was rotated with respect to the end cap 118 and the sealed integrity of the raised portion was interrupted or breached.

FIG. 16 is a detail cross-sectional view of the end closure evidencing the reduced frangible sections 168, which connect the tamper evident element 166 to the cover 120. The tamper evident element 166 is within the opening 124 in the cover 120 as viewed in plan (FIG. 13) and the thickness of the tamper evident element 166 is substantially the same as the thickness of the cover 120 as viewed in section (FIG. 16).

There has been provided by the present invention an improved end closure for a container. The parts are molded from plastic and are easily assembled for use. Preferably, the cover (and knife means) are molded from a harder plastic than the end cap to facilitate severing of the raised portion from the end cap. The configuration of the knife means of FIG. 6 makes it easier to sever the raised portion as compared to the knife means of FIG. 2. The end cap is closed and thus provides for hermetic sealing of the container after packaging. Upon initial use, the raised portion of the end cap is severed and forced from the pour opening to assure that there will be no subsequent interference with pouring of the contents from the pour opening in the end cap as results when the tab for the pour opening is pushed into the container. The rotatable cover fits snuggly in sliding engagement with the end cap as a result of the center connection and the side connection of the two elements. This assures that after the container is opened and the cover opening is positioned out of registry with the pour opening in the end cap, the contents of the container will be sealed. A tamper evident element is secured to the cover and positioned so as to be dislodged or removed from the cover upon initial movement of the cover relative to the end cap in direction to sever the raised portions of the end cap. Thus, dislodging or removal of the tamper evident element will warn the user that there was movement of the cover relative to the end cap that damaged or severed at least a part of the raised portion, breaking the seal integrity thereof.

While we have shown a presently preferred embodiment of the present invention, it will be understood that the invention may be otherwise embodied within the scope of the attached claims.

What is claimed:

1. An end closure for a container comprising a first imperforate stationary part and a second movable part, means for rotatably securing the first part and the second part to one another, said first part having a raised portion secured thereto by severable wall means and said second part having an opening therein for receiving said raised portion, said opening defined at least in part by knife means for severing said severable wall means upon rotational movement of said second part with respect to said first part and for urging the cut raised portion from said first part, and a tamper evident element secured to the second movable part and adapted to be dislodged from the cover upon initial movement of the second part relative to the first part in a direction to sever the severable wall means.

2. An end closure as in claim 1, wherein the tamper evident element is secured to the second part within opening.

3. An end closure as in claim 2 wherein the tamper evident element is connected to the second part by frangible sections, which may be readily broken upon movement of the second part relative to the first part.

4. An end closure for a container comprising a first imperforate stationary part and a second movable part rotatably supported on said first part, said part part being adapted to the hermetically sealed to a container, said first part including a raised portion connected by a severable wall, knife means on said second part for severing the severable wall to remove the raised portion and permit access to the contents of the container, said parts being provided with complementary means for rotatably interconnecting the parts, said complementary means including first cooperating members joining the central portions of the parts and second cooperating members joining the sides of the parts, and tell tale means on the second movable part for evidencing undesirable movement of the second movable part relative to the first part.

5. A container for product including a cylindrical body having a side wall, a bottom affixed at one end of the body, an end closure affixed to the other end of said body, said end closure including an imperforate end cap secured to said body so as to seal the contents therein and a cover rotatably secured to said end cap, said end cap having a raised portion secured thereto by a severable wall, said cover having an opening for receiving said raised portion therein, a tamper evident element detachably secured in said opening, said opening defined at least in part by knife means for cutting the severable wall upon rotation of the cover with respect to the end cap so as to lift the raised portion from the end cap and define a pour opening, initial movement of said cover relative to said end cap dislodging or removing the tamper evident element, said end cap and said cover being provided with complementary means for rotatably interconnecting said end cap and said cover.

6. A container as in claim 5 wherein the tamper evident element is connected to the cover by frangible sections, which may be readily broken upon movement of the cover relative to the end cap.

* * * * *